United States Patent [19]

Wann

[11] Patent Number: 4,709,649

[45] Date of Patent: Dec. 1, 1987

[54] BASS BOAT ADJUSTABLE SEAT APPARATUS

[76] Inventor: Robert E. Wann, 1647 Hobbit Rd., Dunedin, Fla. 33528

[21] Appl. No.: 891,095

[22] Filed: Jul. 31, 1986

[51] Int. Cl.[4] ..... B63B 29/00

[52] U.S. Cl. ..... 114/363; 297/349

[58] Field of Search ..... 114/363; 297/140–143, 297/349, DIG. 4, 340, 344, 346; 16/18 R, 29, 40

[56] References Cited

U.S. PATENT DOCUMENTS

| | | | |
|---|---|---|---|
| 2,517,936 | 8/1950 | Spkes | 297/DIG. 4 |
| 2,650,647 | 9/1953 | MacKnight | 297/349 |
| 2,729,843 | 1/1956 | Seek | 16/18 R |
| 3,151,910 | 10/1964 | Larson | 114/363 |
| 3,203,008 | 8/1965 | Murcott | 297/349 |
| 4,400,032 | 8/1983 | de Polo | 297/349 |
| 4,587,921 | 5/1986 | Currey | 114/363 |

FOREIGN PATENT DOCUMENTS

| | | | |
|---|---|---|---|
| 293589 | 10/1971 | U.S.S.R. | 297/349 |

*Primary Examiner*—Joseph F. Peters, Jr.
*Assistant Examiner*—Edwin L. Swinehart
*Attorney, Agent, or Firm*—Herbert W. Larson; Joseph C. Mason, Jr.

[57] ABSTRACT

An adjustable fishing boat seat is provided offset from a pedestal fastened securely to the deck of a fishing boat. The seat is mounted on a pivot post which is mounted in the top of a frame. The frame is engaged at its bottom to a pair of shafts, each axially engaged with a wheel. A horizontal U-shaped support element separates the pedestal and the frame. The frame is adjustable in position in a horizontal direction over the support element and the shafts are movable in a vertical direction in the frame to provide adjustment of the seat in two planes.

6 Claims, 6 Drawing Figures

BASS BOAT ADJUSTABLE SEAT APPARATUS

BACKGROUND OF THE INVENTION

1. Field of the Invention

This invention relates to boat seats. More particularly, it refers to an adjustable seat for a bass boat.

2. Description of the Prior Art

Bass boats are generally about ten to sixteen feet long with a narrow beam and minimum seating space; usually with only one pedestal mounted seat in the bow and two to three seats in the stern, one of which may be a pedestal mount.

Pedestal mounted seats are desirable for bass boats because they provide elevated seating for better range of vision while casting and looking for fish. Moreover, it allows the fisherman ease of movement from one side of the boat to the other without shifting his weight and causing the boat to rock. This is particularly advantageous during the excitement of battling a fish. Current usage in the field provides for mounting the fishing seat over a pedestal at a fixed location in the boat. These seats rotate, but otherwise only are movable in a vertical direction from a low to a high position.

An attempt to improve on seat mounts in a fishing boat was described in U.S. Pat. No. 3,839,757 and U.S. Pat. No. 4,008,500. The former patent merely provides a means of moving the seat from a high forward position to a lower position further astern. The latter patent describes a chair offset from the pedestal and providing a greater flexibility in use. Although this invention achieves greater flexibility of movement, it requires the positioning of foot pedals for controlling an outboard motor on a platform associated with the pedestal and seat. This greatly increases the expense of the entire apparatus. A less expensive design is needed to provide flexibility of movement without the need for changing standard foot pedal mountings for outboard motor controls.

SUMMARY OF THE INVENTION

I have invented a pedestal-mounted seat which achieves the flexibility of movement needed without substantially increasing the cost for special attachments to utilize outboard motor foot pedals.

My seat apparatus utilizes a pedestal securely mounted to the deck of a boat in a conventional manner. Offset from this pedestal is a seat mounted over a frame that is attached to a pair of L-shaped shafts, each axially engaged with a wheel. The axis of each wheel is perpendicular to a rotation axis with respect to the pedestal. The frame is connected to the pedestal by a horizontal U-shaped support element. The frame is mounted on the U-shaped support element at the bottom of the U, but is adjustable in a horizontal plane. The exact location of the frame on the support element is determined by the exact distance away from the side of the boat that is most comfortable for the fisherman occupying the seat.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
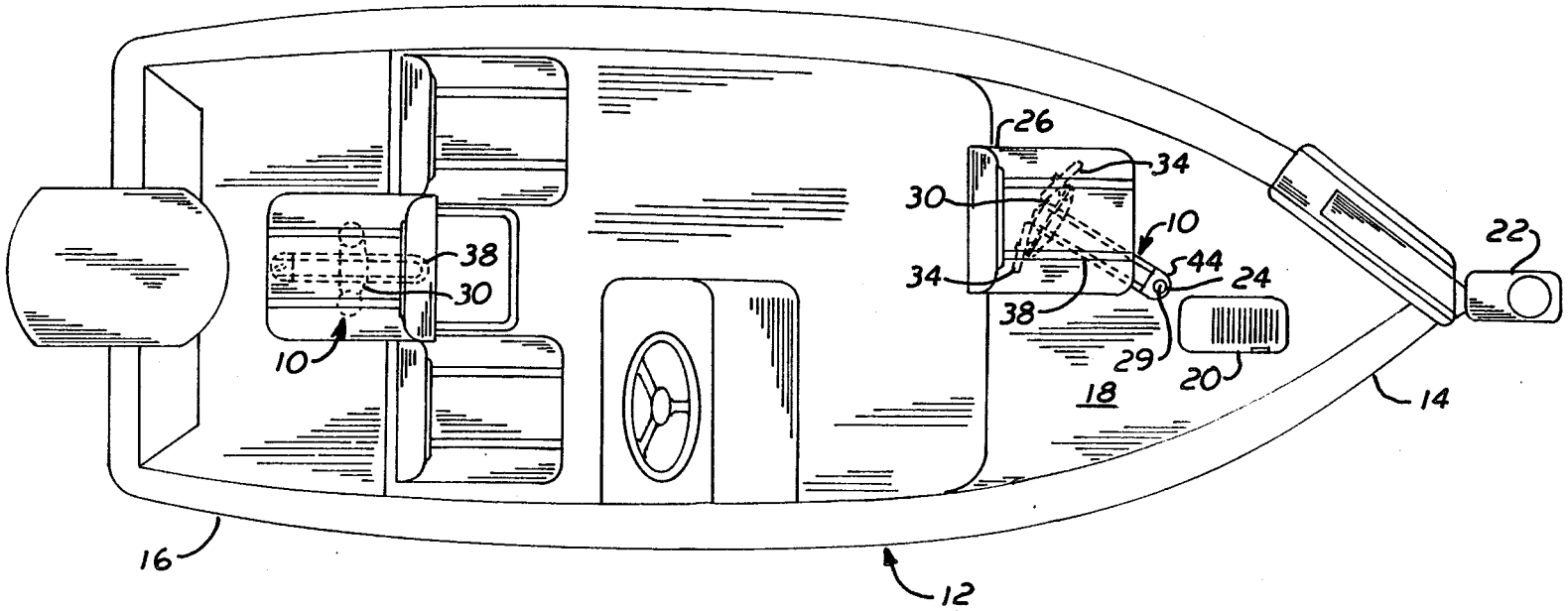
FIG. 1 is a plan view of a bass boat with a bow and stern pedestal adjustable seat mount.
Figure 2:
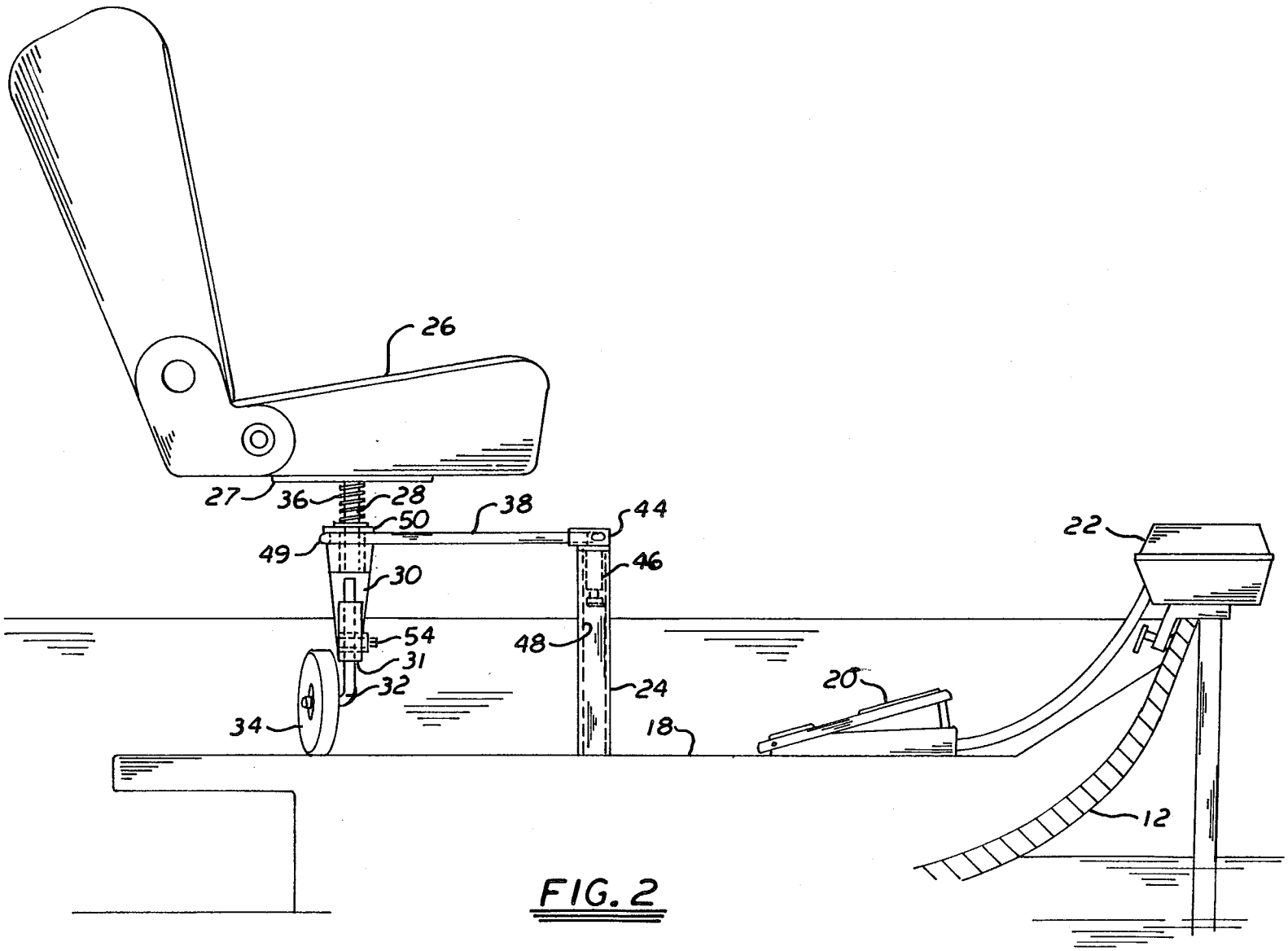
FIG. 2 is a starboard side elevation view of the adjustable seat and its attachment to the pedestal.
Figure 3:
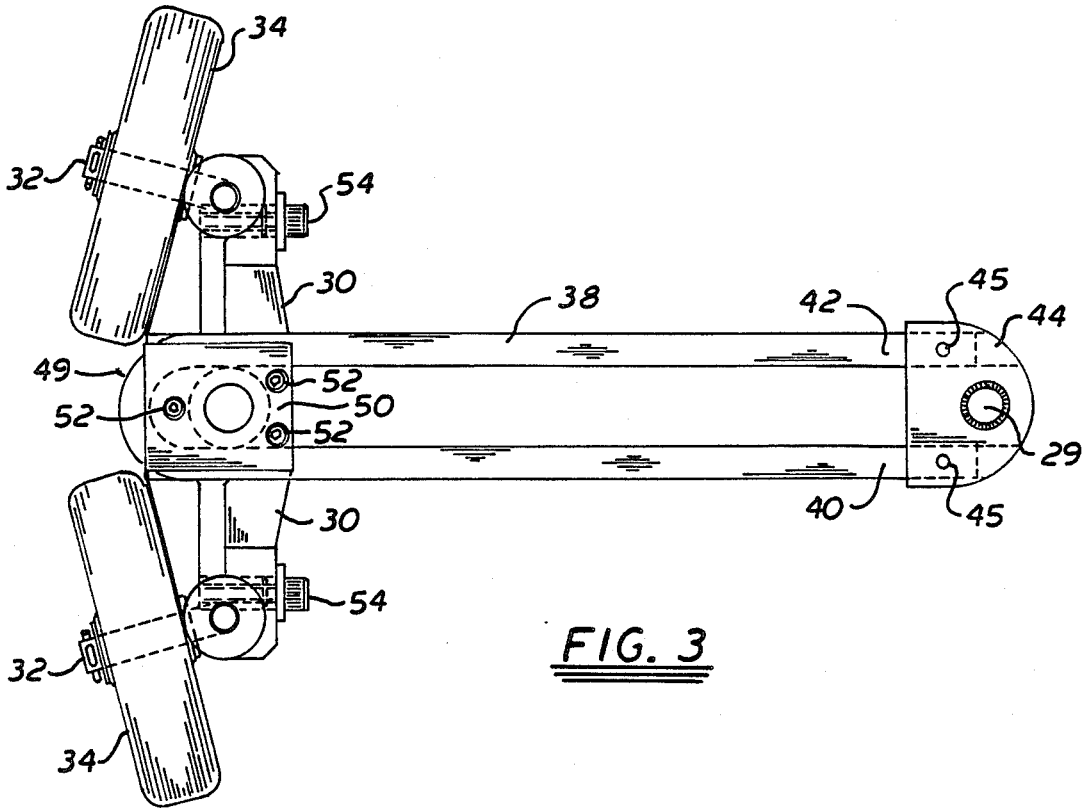
FIG. 3 is a plan view of the U-shaped support element connecting the frame and pedestal.
Figure 4:
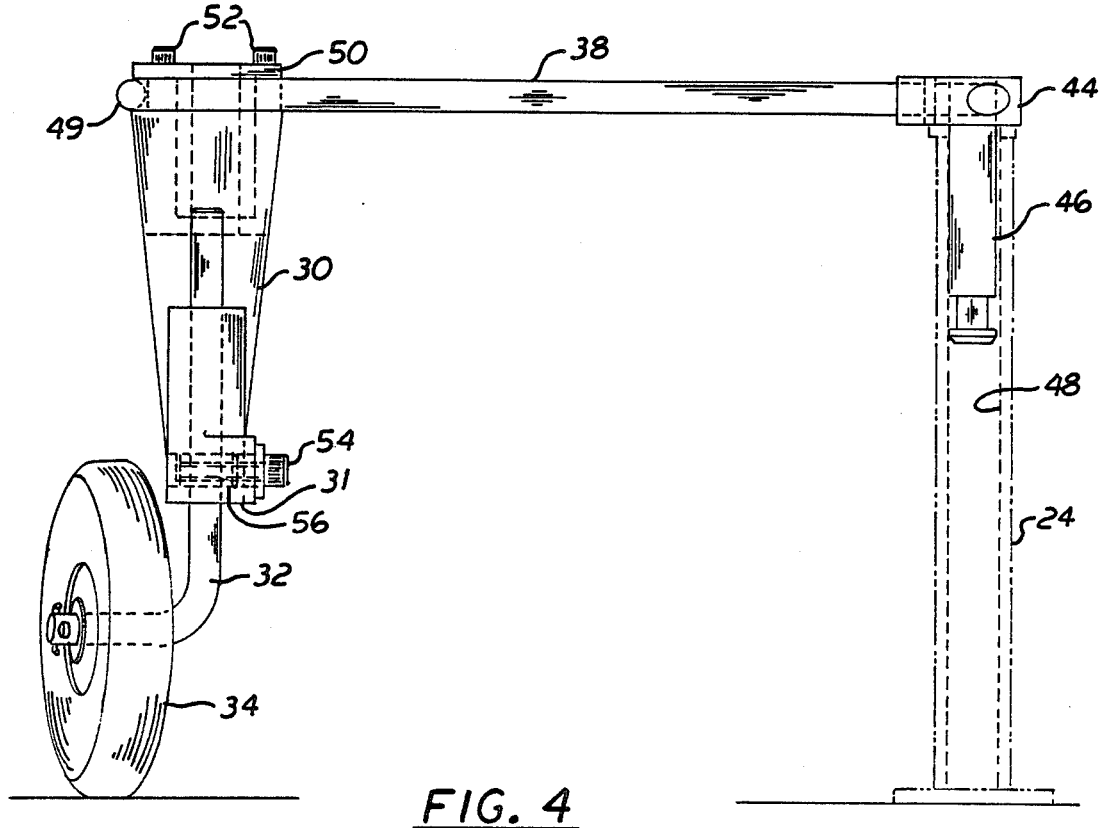
FIG. 4 is a detailed elevation view of the frame, U-shaped support element and pedestal.
Figure 5:
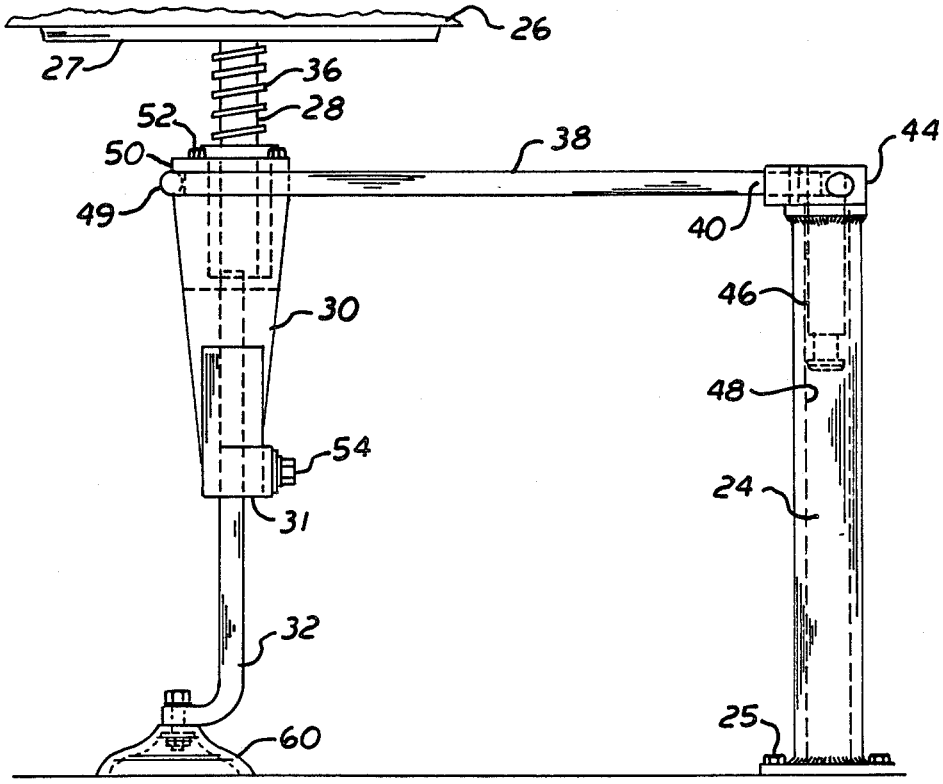
FIG. 5 is an elevation view similar to FIG. 4 with an alternate to the wheels.
Figure 6:
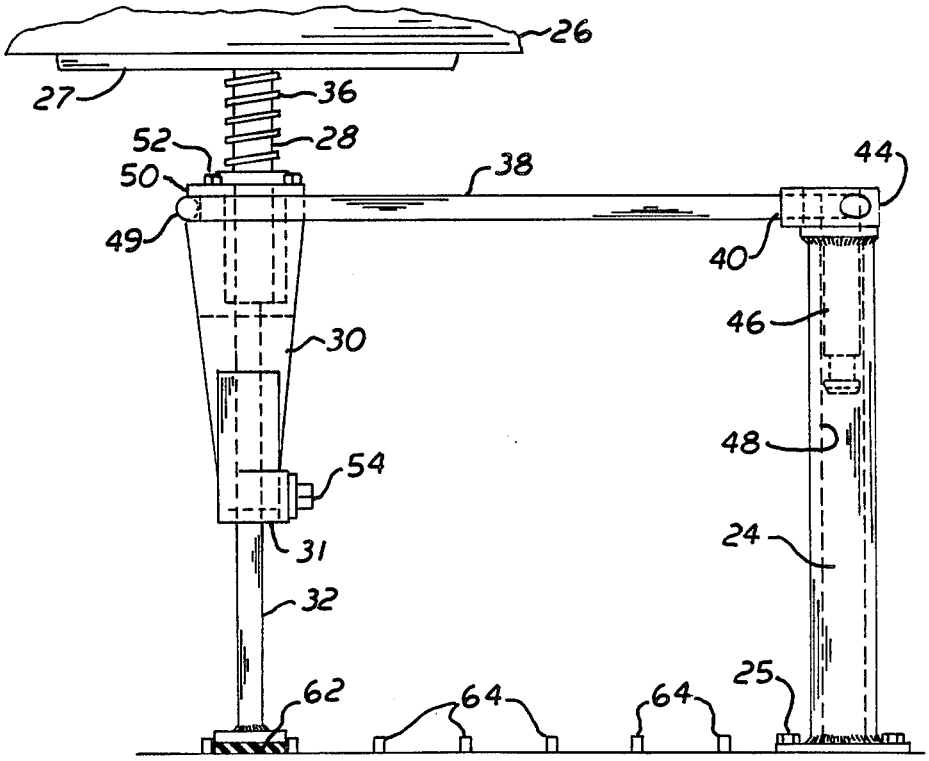
FIG. 6 is an elevation view similar to FIG. 4 with another alternate to the wheels.

Throughout the following detailed description, the same reference numerals refer to the same elements in all figures.

The adjustable seat apparatus 10 is mounted in a boat 12 in either or both the bow 14 or stern section 16 and is bolted to deck 18 at its pedestal mount 24.

The adjustable seat apparatus 10 is positioned in proximity to a foot pedal 20 for actuating a trolling motor 22. The pedestal 24 is bolted through the deck with bolts 25 or by a through deck conventional fitting (not shown).

A fisherman's seat 26 has a base 27 from which projects a central pivot post 28 that rotates in a frame 30. The bottom end 31 of the frame 30 has projecting from it a pair of L-shaped shafts 32 each axially engaged with a wheel 34.

A coil spring 36 surrounds the top portion of pivot post 28 and is located between the seat base 27 and the top of clamp plate 50. Separating the frame 30 and the pedestal 24 is a U-shaped adjustable support element 38. Each arm 40 and 42 of support element 38 inserts into a pedestal cap 44 and is bolted or screwed in place with bolts or screws 45. The pedestal cap 44 has a downwardly projecting shaft 46 which fits into the hollow portion 48 of the pedestal 24 and rotates therein.

The shaft 46, which is welded to the pedestal cap 44, moves freely within the pedestal so as to allow the adjustable support element to move around in a potentially 360 degree circle. For practical purposes, it only needs to move about 45 degrees in each direction port and starboard from the centerline of the boat.

The closed end 49 of the adjustable support element 38 has a clamp plate 50 locked over it with fasteners 52. The fasteners are either bolts or screws to clamp the adjustable support element between plate 50 and the frame 30. The bolts or screws 52 can be released so that the entire frame can be moved along the adjustable support element 38. A fisherman can position his seat in accordance with the distance away from the pedestal 24 which is most comfortable for fishing conditions.

The L-shaped shaft 32 is locked to the interior of frame 30 by a locking screw 54 that locks depression cam lock 56 in place over the shaft 32. By releasing locking screw 54, the shaft 32 can be lowered or raised with respect to the frame 30. The wheel 34 is axially positioned on the end of shaft 32 so that its axis is perpendicular to the rotation axis of the pivot point 29 on the pedestal 24. In this manner each wheel travels an arc over the deck of the boat relevant to the pivot point 29 on pedestal 24. Each wheel 34 is angled at about 30 degrees more or less to the horizontal length of frame 30 in order to achieve the correct arc.

If the fisherman desires a non-moveable chair, the wheels are merely replaced by a suction device 60 or by a rubber pad 62. If the rubber pad is used, there needs to be stops 64 on the deck to provide a position to engage the rubber pads 62 as the seat is moved along the adjustable support element 38.

The frame, pedestal and horizontal support member can be made from high strength aluminum, the shafts from steel and the wheels can be polyethylene or an elastomer.

Equivalent elements can be substituted for the various adjustable support elements and shafts of the present invention without departing from its scope.

Having thus described the invention, what is claimed and desired to be secured by Letters Patent is:

1. A fishing boat seat apparatus comprising:

(a) a pedestal securely mounted to a deck of the boat, (b) a frame supporting a seat, (c) a pair of shafts, each engaged to the frame at an upper end and in engagement with an element in contact with the deck at a lower end, the frame movable in a vertical direction with respect to the shafts, (d) a U-shaped horizontal support element connecting the pedestal and the frame, (e) the support element having an open end attached to a mounting element rotatably mounted on the pedestal and a closed end clamped to the frame, the frame movable in a horizontal direction within the horizontal support element by releasing a clamp plate.

2. A fishing boat seat apparatus according to claim 1 wherein a pivot post mounted at a top of the frame and surrounded by a coil spring separates the seat from the frame.

3. A fishing boat seat apparatus according to claim 1 wherein the U-shaped horizontal support element is clamped between the clamp plate and the frame at the closed end, and in the mounting element at the open end, the mounting element being rotatable within a receptacle in the pedestal, the pedestal forming a pivot point axis with the mounting element.

4. A fishing boat seat apparatus according to claim 1 wherein each shaft is in axial engagement with a wheel at its lower end, the wheels each being at a right angle to the axis of the pivot point.

5. A fishing boat seat apparatus comprising (a) a pedestal securely mounted to a deck of the boat at a lower end of the pedestal and a mounting element rotatably mounted within a receptacle in an upper end of the pedestal, (b) a seat supported by a pivot post rotatably mounted in an upper end of a frame member with a pair of L-shaped shafts locked within a pair of corresponding bore holes in a bottom end of the frame, each shaft axially attached to a wheel, (c) a U-shaped horizontal support element connecting the mounting element and frame at opposite ends, with the frame movable along the support element in a horizontal plane towards and away from the pedestal and movable with respect to the shafts in a vertical plane, (d) the horizontal support element engaged by a clamp plate and secured to the frame by fasteners to hold the frame in a fixed position with respect to the pedestal.

6. A fishing boat seat apparatus according to claim 5 wherein the wheels are each angled at right angles to an axis of the pedestal.

* * * * *